US008293342B2

(12) United States Patent
Adams

(10) Patent No.: US 8,293,342 B2
(45) Date of Patent: Oct. 23, 2012

(54) DECORATIVE GOLF FIGURINE

(76) Inventor: Crystal V. Adams, Kingman, AZ (US)

( * ) Notice: Subject to any disclaimer, the term of this patent is extended or adjusted under 35 U.S.C. 154(b) by 203 days.

(21) Appl. No.: 12/805,235

(22) Filed: Jul. 20, 2010

(65) Prior Publication Data

US 2011/0076426 A1 Mar. 31, 2011

Related U.S. Application Data

(60) Provisional application No. 61/272,468, filed on Sep. 28, 2009.

(51) Int. Cl.
*A63H 3/48* (2006.01)
*A63H 3/00* (2006.01)

(52) U.S. Cl. ..... 428/16; 428/7; 428/542.2; 428/542.4; 428/15; 29/525.09

(58) Field of Classification Search ..... 428/4, 5, 428/7, 8, 9, 11, 12, 16, 542.2, 542.4; D11/131, D11/160, 161, 184; 29/525.09
See application file for complete search history.

(56) References Cited

U.S. PATENT DOCUMENTS

| | | | | | |
|---|---|---|---|---|---|
| D65,513 | S | | 9/1924 | Allison | |
| 1,818,737 | A | * | 8/1931 | Moser | 428/542.4 |
| D146,129 | S | * | 12/1946 | Blackhall et al. | D19/97 |
| D151,600 | S | * | 11/1948 | Colm | D21/406 |
| RE23,612 | E | * | 1/1953 | Abel | 446/166 |
| D174,195 | S | * | 3/1955 | Reising | D11/157 |
| 3,143,265 | A | * | 8/1964 | Ruderian | 294/142 |
| D201,102 | S | | 5/1965 | Panek | |
| 3,473,247 | A | * | 10/1969 | La Favor et al. | 40/538 |
| 3,526,103 | A | * | 9/1970 | Lieber | 63/23 |
| 3,879,874 | A | * | 4/1975 | Broussard, Sr. | 40/768 |
| D260,867 | S | | 9/1981 | Evans | |
| 4,333,974 | A | * | 6/1982 | Davis | 428/16 |
| D280,229 | S | | 8/1985 | Parent | |
| 4,761,314 | A | * | 8/1988 | Marshall | 428/11 |
| D300,335 | S | | 3/1989 | Colclasure | |
| 4,883,441 | A | | 11/1989 | Byer | |
| D319,170 | S | * | 8/1991 | Franke | D8/38 |
| D326,114 | S | * | 5/1992 | Murtagh | D19/97 |
| 5,165,538 | A | * | 11/1992 | Peters | 206/315.9 |
| D418,935 | S | * | 1/2000 | Gilbert et al. | D26/68 |
| D419,481 | S | | 1/2000 | Duff | |
| 6,027,752 | A | * | 2/2000 | Coleman et al. | 426/134 |
| D438,271 | S | * | 2/2001 | Wall | D21/714 |
| 6,234,863 | B1 | | 5/2001 | Hughey et al. | |
| D487,879 | S | | 3/2004 | MacNeil | |
| 2006/0057308 | A1 | * | 3/2006 | Huang | 428/9 |

* cited by examiner

*Primary Examiner* — Aaron Austin
(74) *Attorney, Agent, or Firm* — Richard C. Litman

(57) ABSTRACT

The decorative figurine is formed from at least two golf balls and at least one golf tee. A blind bore is formed in a first golf ball, and a diametrically extending countersunk bore is formed through a second golf ball. A golf tee is then inserted into the golf balls with the shaft extending through the countersunk bore and into the blind bore, the head of the tee being seated in the countersunk portion of the throughbore. Adhesive secures the tee in the bores, forming the body of the figurine. The body is preferably mounted on a base, and the body is decorated with any desired ornamentation and/or props.

10 Claims, 3 Drawing Sheets

DECORATIVE GOLF FIGURINE

CROSS-REFERENCE TO RELATED APPLICATION

This application claims the benefit of U.S. Provisional Patent Application Ser. No. 61/272,468, filed Sep. 28, 2009.

FIELD OF THE INVENTION

The present invention relates to novelty decorations, and particularly to a decorative golf figurine and a method of making the figurine, the figurine having a body made from at least two golf balls and at least one golf tee that can be adorned with various forms of ornamentation, as desired.

DESCRIPTION OF THE RELATED ART

Figurines and toys simulating human beings, or collections of figurines having a common theme, are well known in the art. Such figurines and toys are typically either in the form of a stuffed doll, or are formed through a molding process. Stuffed dolls are typically formed via a cutting and stitching process and molding of plastics or the like may be performed through conventional injection molding or the like. Both methods involve a complex series of procedures, specialized materials and, particularly in the case of molding, highly specialized equipment.

Golf is a universal leisure time activity and avocation that is enjoyed by men and women of all professions throughout the world. Golfers have such love and devotion for the sport that decorative items that stimulate recollections or images related to the sport produce considerable aesthetic satisfaction. Nevertheless, relatively few decorative items are available that are made from articles commonly used by golfers in the practice of the sport every day.

It would be desirable to provide a method of forming a figurine which is relatively easy and inexpensive, allowing a person to form the figurine easily in his or her own home. Further, it would be desirable to provide a figurine that includes materials indicative and illustrative of the overall theme of the figurine. Thus, a decorative golf figurine solving the aforementioned problems is desired.

SUMMARY OF THE INVENTION

The decorative golf figurine is formed from at least two golf balls and at least one golf tee. In order to construct the decorative figurine, a radially extending blind bore is formed in a first golf ball. A countersunk bore extending is formed through a second golf ball, the countersunk bore diametrically through the second golf ball. A golf tee adhesively joins the first and second golf balls, the shaft of the tee extending through the diametric bore in the second golf ball and into the blind bore of the first golf ball, the head of the tee being seated in the countersunk bore, thereby forming the body of the figurine. The body of the figurine may then be mounted on a base and adorned with any desired ornamentation, typically, but not necessarily, simulating or forming a caricature of a human, with or without props.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
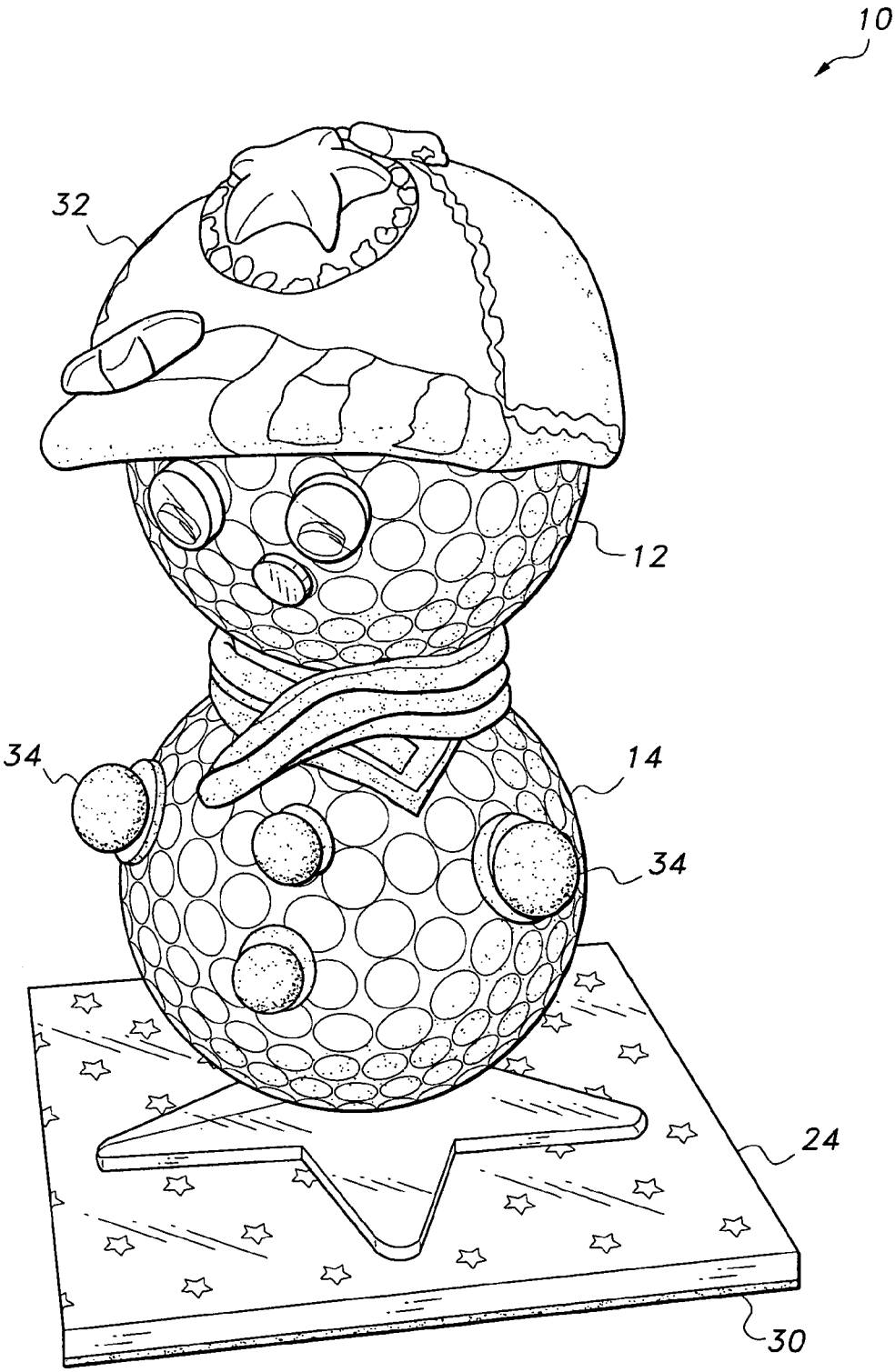
FIG. 1 is a perspective view of a decorative golf figurine according to the present invention.
Figure 2:
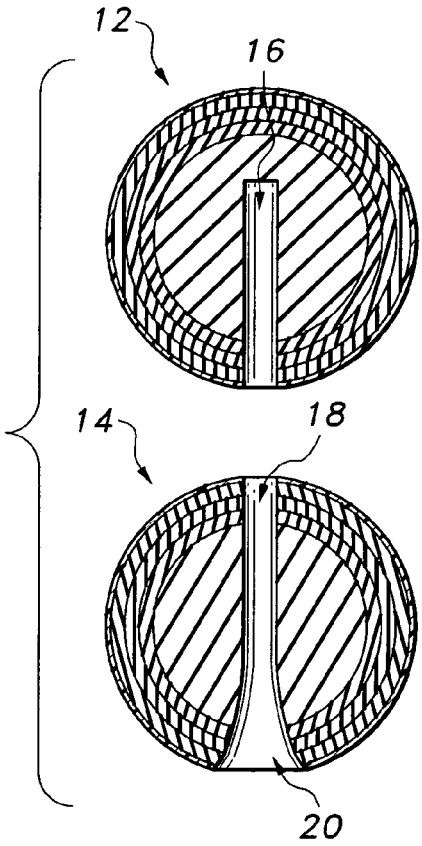
FIG. 2 is an exploded side view in section illustrating a first method step to make the body of a decorative golf figurine according to the present invention.

Referring to FIG. 1, the decorative golf figurine 10 is formed from at least two golf balls and at least one golf tee. In order to construct the decorative golf figurine 10, certain steps are followed to form the body of the figurine 10. As shown in FIG. 2, a blind bore 16 is formed in a first golf ball 12. The blind bore 16 extends radially to about the center of the ball 12. A countersunk bore 18 is formed through a second golf ball 14. The countersunk bore 18 extends diametrically completely through the second golf ball 14.

Preferably, first and second golf balls 12, 14 are conventional golf balls having conventional size and features (such as dimpling on an outer surface thereof, etc.). It should be understood that more than two golf balls may be used in the construction of figurine 10, and that first and second golf balls 12, 14 are being shown for illustrative purposes only. As will be described below, the shaft of a golf tee 22 is inserted through the countersunk bore 18 and into the blind bore 16, the two bores 16, 18 being dimensioned and configured to snugly receive the shaft of the golf tee 22. Preferably, the bores 16, 18 each have a diameter of approximately 15/64 inches in order to snugly receive the shaft of the golf tee 22.

The countersunk portion 20 of bore 18 may be conical or cylindrical, but in any event, is dimensioned and configured to receive the head of the golf tee 22 so that the head is seated therein with no portion of the tee extending or protruding beyond the circumference of the ball 14. The blind bore 16 and countersunk bore 18 may be formed by any suitable process, such as drilling, filing or the like. The countersunk portion 20 preferably has a diameter of approximately ½ inches.

Figure 3:
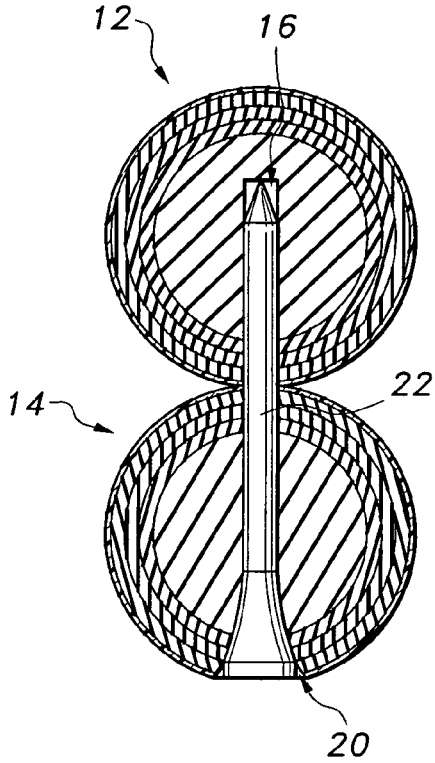
FIG. 3 is a side view in section illustrating a second method step to make the body of a decorative golf figurine according to the present invention.

As noted above, and as shown in FIG. 3, the golf tee 22 is inserted through the aligned bores 16, 18 so that the sharp point at the end of the shaft of the tee 22 is positioned within the blind bore 16 of the first golf ball 12 substantially to or beyond the center of the ball 12. The golf tee 22 joins the first and second golf balls 12, 14 together using an adhesive, such as hot glue, epoxy, or the like. The two golf balls 12, 14 joined together by the golf tee 22 form the body of the figurine 10.

Figure 4:
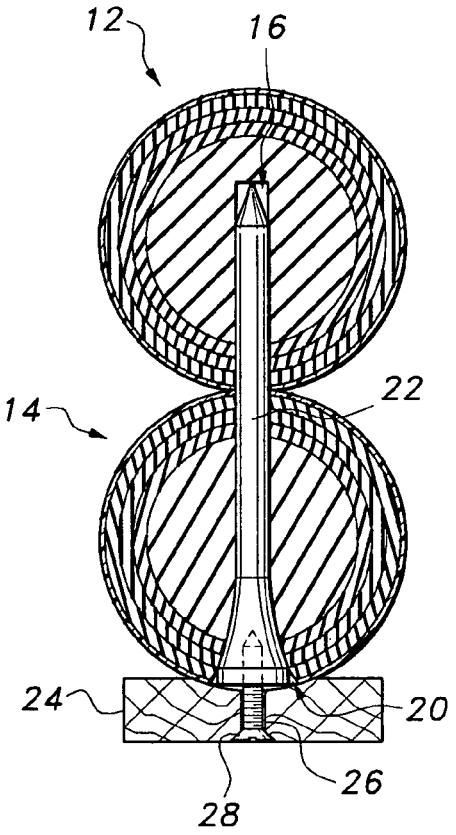
FIG. 4 is a side view in section illustrating a method of mounting the body of a decorative golf figurine according to the present invention onto a base.

As shown in FIG. 4, the body of the figurine 10 is preferably mounted on a base 24 to keep the figuring standing upright. The base may have any desired dimensions or configuration, depending upon the decorative effect desired by the user, and may be formed from any suitable material, such as wood or the like.

In the exemplary base 24 shown in FIG. 4, a countersunk bore 26 is formed through the base 24 for receiving a screw 28 or the like. The screw 28 (which may be a self-tapping sheet metal screw, a wood screw, or any other threaded fastener) passes through the bore 26 and is threaded into the head of golf tee 22, the head of the screw 28 being seated in the countersunk portion (which may be conical or cylindrical) of the bore 26 so that no portion of the head of the screw protrudes below the base 24. It should be understood that base 24 may be secured to second golf ball 14 by any suitable type of fastener, which may be a threaded fastener or an unthreaded fastener (e.g., a dowel and wood glue).

Figure 5:
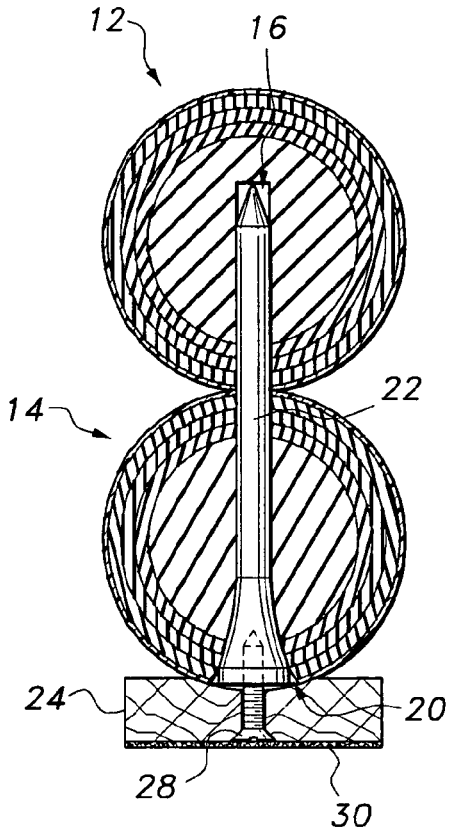
FIG. 5 is a side view in section illustrating the body of a decorative golf figurine according to the present invention mounted on a base.

As shown in FIG. 5, a padded layer 30, such as foam or felt, may then secured to a lower surface of the base 24 using an adhesive, such as glue, or the like, to cover the countersunk hole and the screw 28 or other fastener. At least one decorative element is then attached to at least one of the first and second golf balls 12, 14 to form the figurine 10. It should be understood that any desired decorative elements may be utilized, depending upon the desired decorative effect or theme selected by the user. In the example of FIG. 1, a hat 32, facial features, hands 34 formed from felt or the like, and other decorative features have been affixed to first and second golf balls 12, 14 by glue or the like. The ornaments and/or props used to decorate the body of the figurine may be related to golf, or may be selected to simulate or caricature any desired profession, other sports activities, or inanimate objects, if desired. Furthermore, the base 24 may be elongated and decorated or adorned with other props (e.g., with a flag marking a cup on a golf green), if desired.

It is to be understood that the present invention is not limited to the embodiments described above, but encompasses any and all embodiments within the scope of the following claims.

I claim:

1. A decorative golf figurine, comprising:

a first golf ball having a blind bore extending radially into the first golf ball;

a second golf ball having a bore aligned with the blind bore and extending diametrically through the second golf ball and having a countersunk hole at one end opposite the blind bore;

a shaft extending through the bore in the second golf ball and into the blind bore in the first golf ball, wherein said shaft comprises a golf tee having a head attached to the shaft and being configured to snugly engage the countersunk hole, the shaft joining the first and second golf balls together to form a body of the figurine; and decorative ornamentation disposed on the body of the figurine.

2. The decorative golf figurine according to claim 1, further comprising a base, said second golf ball being attached to the base, the figuring body being mounted in an upright position on the base.

3. The decorative golf figurine according to claim 2, further comprising a fastener connecting said base to said figurine body.

4. The decorative golf figurine according to claim 3, wherein the base has a bottom, the base further comprising a padded layer covering the bottom of the base.

5. The decorative golf figurine according to claim 2, wherein the base has a bottom, the base further comprising a padded layer covering the bottom of the base.

6. The decorative golf figurine according to claim 1, wherein said decorative ornamentation comprises facial features.

7. The decorative golf figurine according to claim 1, wherein said decorative ornamentation comprises clothing features.

8. The decorative golf figurine according to claim 1, wherein said decorative ornamentation comprises humanoid, animal or caricature body features.

9. The decorative golf figurine according to claim 1, wherein said decorative ornamentation comprises a combination of facial, clothing and body features.

10. The decorative golf figuring according to claim 9, wherein said body features are selected from the group consisting of humanoid, animal or caricature.

* * * * *